US008131183B2

(12) United States Patent
Ito

(10) Patent No.: US 8,131,183 B2
(45) Date of Patent: Mar. 6, 2012

(54) DEVELOPER COLLECTION CONTAINER, DEVELOPER CARTRIDGE, DEVELOPING UNIT AND IMAGE FORMING APPARATUS

(75) Inventor: Junichi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 659 days.

(21) Appl. No.: 12/292,387

(22) Filed: Nov. 18, 2008

(65) Prior Publication Data

US 2009/0136259 A1 May 28, 2009

(30) Foreign Application Priority Data

Nov. 27, 2007 (JP) ..... 2007-305508

(51) Int. Cl.
*G03G 21/12* (2006.01)

(52) U.S. Cl. ..... 399/120; 399/358; 399/360

(58) Field of Classification Search ..... 399/358, 399/359, 360, 120, 256
See application file for complete search history.

(56) References Cited

U.S. PATENT DOCUMENTS

| | | | | |
|---|---|---|---|---|
| 5,383,578 | A * | 1/1995 | Nishimura | 399/360 |
| 2002/0114651 | A1 * | 8/2002 | Wang | 399/358 |

FOREIGN PATENT DOCUMENTS

| | | |
|---|---|---|
| JP | 5-232846 | 9/1993 |
| JP | 2000-132033 | 5/2000 |
| JP | 2003-345116 | 12/2003 |
| JP | 2004-102137 | 4/2004 |
| JP | 2005-91847 | 4/2005 |
| JP | 2005-292366 | 10/2005 |
| JP | 2005-316351 | 11/2005 |

OTHER PUBLICATIONS

Machine translation of JP 05-232846 A dated Jul. 19, 2011.*
Machine translation of JP 2005-091847 A dated Jul. 19, 2011.*

* cited by examiner

*Primary Examiner* — Sophia S Chen
(74) *Attorney, Agent, or Firm* — Rabin & Berdo, PC

(57) ABSTRACT

A developer collection container includes a developer storing portion having first and second end portions in a longitudinal direction thereof. A developer supply opening is provided on the first end portion through which the developer is supplied into the developer storing portion. A rotation member is rotatably provided so as to extend substantially from the first end portion to the second end portion. The rotation member rotates so as to convey the developer in the longitudinal direction of the developer storing portion. In a first region closer to the first end portion, the rotation member conveys the developer in a direction from the first end portion toward the second end portion with a conveying power which is larger than a conveying power with which the rotation member conveys the developer in a second region closer to the second end portion.

14 Claims, 13 Drawing Sheets

COMPARATIVE EXAMPLE

DEVELOPER COLLECTION CONTAINER, DEVELOPER CARTRIDGE, DEVELOPING UNIT AND IMAGE FORMING APPARATUS

BACKGROUND OF THE INVENTION

The present invention relates to an image forming apparatus using electrophotographic technology such as a printer, a facsimile machine or a copier, and relates to a developer collection container, a developer cartridge and a developing unit used in the image forming apparatus.

In a conventional image forming apparatus, a developer collection container is provided for collecting a waste toner (i.e., a residual toner that has not been transferred to a recording medium). The developer collection container has a collection opening through which the waste toner falls into the developer collection container. The collection opening is formed on, for example, an end portion of the developer collection container in a longitudinal direction of the developer collection container. A conveying member with a spiral auger is provided in the developer collection container, and conveys the waste toner (having fallen from the collection opening) toward an opposite end portion of the developer collection container so as not to cause stagnation of the waste toner in the vicinity of the collection opening.

Such a developer collection container is disclosed in, for example, Japanese Laid-Open Patent Publication No. 2005-316351 (Page 6, FIG. 5).

In the conventional toner collection container, the conveying member partly extends in the longitudinal direction of the toner collection container, and therefore it is difficult to efficiently store the waste toner throughout the toner collection container.

SUMMARY OF THE INVENTION

The present invention is intended to provide a developer collection container, a developer cartridge, a developing unit and an image forming apparatus capable of efficiently storing the developer throughout the developer collection container.

The present invention provides a developer collection container including a developer storing portion for storing a developer. The developer storing portion has an elongated shape and has first and second end portions in a longitudinal direction thereof. A developer supply opening is provided on the first end portion of the developer storing portion through which the developer is supplied into the developer storing portion. A rotation member is rotatably provided in the developer storing portion so as to extend substantially from the first end portion to the second end portion in the longitudinal direction of the developer storing portion. The rotation member rotates in a predetermined direction so as to convey the developer in the longitudinal direction of the developer storing portion. In a first region closer to the first end portion, the rotation member conveys the developer in a direction from the first end portion toward the second end portion with a conveying power which is larger than a conveying power with which the rotation member conveys the developer in a second region closer to the second end portion.

With such a configuration, the developer supplied into the developer storing portion is conveyed throughout the developer storing portion in the longitudinal direction thereof. Therefore, the developer can be efficiently stored throughout the developer storing portion.

The present invention also provides a developer cartridge including the above described developer collection container, and a fresh developer collection container for storing a fresh developer.

The present invention also provides a developing unit including the above described developer cartridge, and a developing unit main body to which the developer cartridge is detachably mounted. The developing unit main body includes a developer ejecting portion that engages the developer supply opening of the developer cartridge so as to supply the developer into the developer storing portion.

The present invention also provides an image forming apparatus including the above described developing unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Embodiment 1

Figure 1:
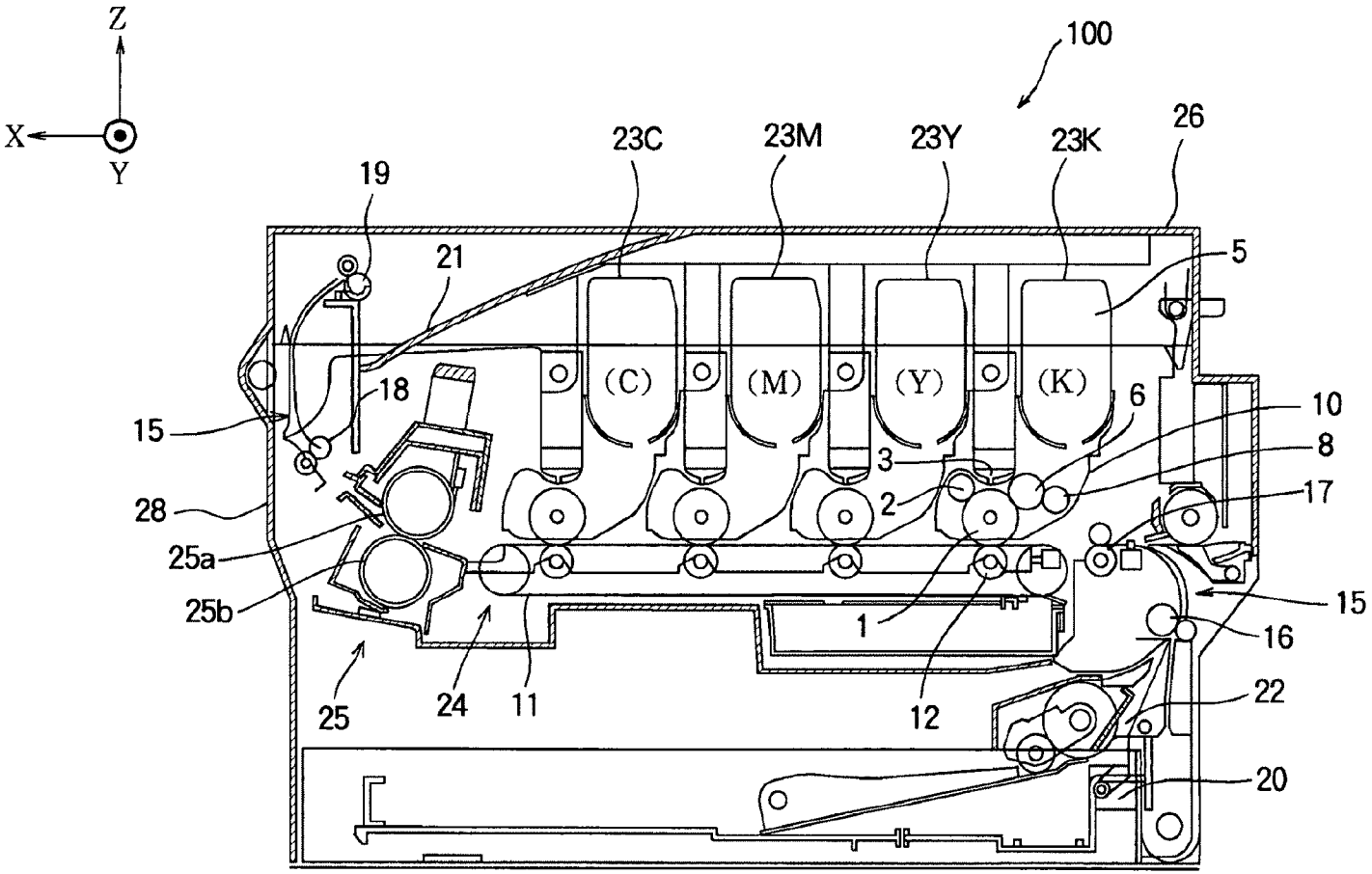
FIG. 1 is a schematic view showing an image forming apparatus in which a toner cartridge as a developer cartridge according to Embodiment 1 of the present invention is employed.

FIG. 1 is a schematic view showing a configuration of an image forming apparatus in which a toner cartridge as a developer cartridge according to Embodiment 1 of the present invention is employed.

The image forming apparatus 100 is configured as a color electrophotographic printer capable of printing four colors of black (K), yellow (Y), magenta (M) and cyan (C). The image forming apparatus 100 has a main body including a lower frame 28 and an upper frame 26. A sheet feeding path 15, which is substantially S-shaped, is defined in the lower frame 28.

A sheet cassette 20 for storing recording sheets (i.e., recording media) is provided in a lower part of the lower frame 28. The sheet cassette 20 is disposed on an upstream end of the feeding path 15. A sheet supply portion 22 is disposed adjacent to the sheet cassette 20. The sheet supply portion 22 picks up the recording sheet in the sheet cassette 20 and feeds the recording sheet one by one out of the sheet cassette 20.

Feeding roller pairs 16 and 17 are disposed along the feeding path 15 on the downstream side of the sheet supply portion 22. The feeding roller pairs 16 and 17 are configured to feed the recording sheet (supplied by the sheet supply portion 22) to a transfer belt unit 24 described below.

The transfer belt unit 24 is disposed on the downstream side of the feeding roller pair 17 along the feeding path 15. The transfer belt unit 24 includes a transfer belt 11 electrostatically absorbing the recording sheet, and conveys the recording sheet from the right to the left in FIG. 1.

Developing units 23K, 23Y, 23M and 23C (i.e., image forming units) are linearly disposed so as to face the transfer belt unit 24 via the recording sheet being held and fed by the transfer belt 11. The developing units 23K, 23Y, 23M and 23C respectively store toners (developers) of black (K), yellow (Y), magenta (M) and cyan (C). The developing units 23K, 23Y, 23M and 23C are collectively referred to as a developing unit 23. The developing units 23K, 23Y, 23M and 23C are detachably mounted to the main body of the image forming apparatus 100.

XYZ-coordinate shown in FIG. 1 is defined as follows. X-direction is defined as a feeding direction of the recording sheet passing the developing units 23*k*, 23Y, 23M and 23C. Y-direction is defined as an axial direction of a photosensitive body 1 (described later) of each developing unit 23. Z-direction is defined as being perpendicular to both of the X-direction and the Y-direction. In other figures, X-direction, Y-direction and Z-direction indicate the same directions as those shown in FIG. 1. In other words, XYZ-coordinates in the respective figures indicate orientations of components shown in the respective figures when the components are assembled into the image forming apparatus 100 of FIG. 1.

In this embodiment, the developing units 23K, 23Y, 23M and 23C have the same configurations except toners, and therefore a configuration of the developing unit 23K of black (K) will be herein described.

Figure 2:
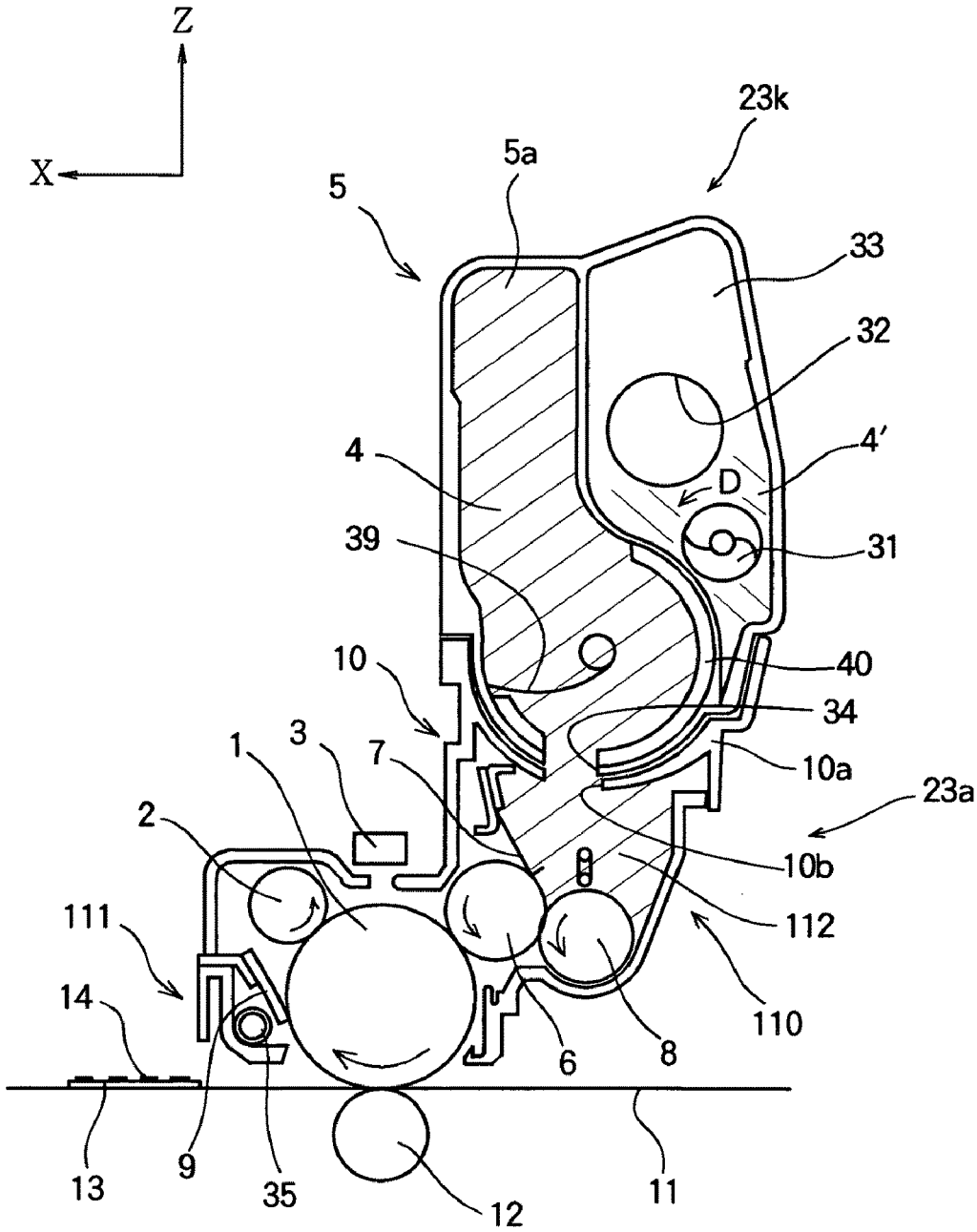
FIG. 2 is a schematic view showing a developing unit of black (K) together with a transfer roller, an exposing device and a recording medium.

FIG. 2 is a schematic view showing the developing unit 23K of black (K) together with a transfer roller 12, an exposing device 3 and a recording medium 13.

As shown in FIG. 2, the developing unit 23K (i.e., the image forming unit) includes a photosensitive body 1 having a surface capable of bearing electric charge and the electric charge can be removed by exposure with light. The photosensitive body 1 is rotatable in a direction shown by an arrow in FIG. 2. Along the circumference of the photosensitive body 1, a charging roller 2, an exposing device 3, a developing portion 110, a transfer roller 12 and a cleaning blade 9 are provided in this order in the rotational direction of the photosensitive body 1.

The charging roller 2 is urged against the surface of the photosensitive body 1, and electrically charges the surface of the photosensitive body 1. The exposing device 3 is composed of LED or the like and exposes the surface of the photosensitive body 1 to form a latent image. The exposing device 3 is mounted to the upper cover 26 of the image forming apparatus 100 (FIG. 1).

The developing portion 110 develops the latent image using a toner of a predetermined color (in this example, black) by causing the toner to adhere to the surface of the photosensitive body 1 where the latent image is formed. The transfer roller 12 will be described later. The cleaning blade 9 removes the residual toner remaining on the surface of the photosensitive body 1 after the transferring of the toner image to the recording sheet 13, and causes the toner to fall in a waste toner collecting portion 111. The cleaning blade 9 is formed of a resilient material, and has an edge portion contacting the surface of the photosensitive body 1 with a predetermined pressure. A waste toner conveying member 35 is provided in the waste toner collecting portion 111. The waste toner conveying member 35 is in the form of a spiral or coil spring, and conveys the waste toner in a predetermined direction (+Y direction) as described later. Rotating bodies (i.e., rollers and drum) of the developing unit 23K are rotated by not shown driving sources via gears.

The developing portion 110 includes a toner cartridge 5 (i.e., a developer cartridge) storing a fresh toner 4 therein and having an elongated toner supply opening 34 through which the fresh toner 4 is supplied. The developing portion 110 further includes a toner reservoir 112 that receives the fresh toner 4 supplied by the toner cartridge 5, a developing roller 6 provided so as to contact the photosensitive body 1, a toner supply roller 8 that supplies the fresh toner 4 to the developing roller 6, and a developing blade 7 that forms a thin layer of the fresh toner 4 on the surface of the developing roller 6. With such a configuration, the developing portion 110 visualizes (i.e., develops) the latent image on the surface of the photosensitive body 1. The developing roller 6, the toner supply roller 8 and the developing blade 7 are respectively connected to a developing roller power source, a supply roller power source and a developing blade power source (not shown) and are applied with predetermined bias voltages.

The developing unit 23K is configured so that the toner cartridge 5 is detachably mounted on a portion above the toner supply roller 8. A part of the developing unit 23K except the toner cartridge 5 is referred to as a developing unit main body 23*a* (i.e., an image forming unit main body). The developing unit main body 23*a* is enclosed by a housing 10. The housing 10 has a cover frame 10*a* on which the toner cartridge 5 is placed for supplying the fresh toner 4 to the toner reservoir 112. The cover frame 10*a* has a toner replenishing opening 10*b* for receiving the fresh toner 4 supplied by the toner cartridge 5, and the toner replenishing opening 10*b* corresponds to the toner supply opening 34 of the toner cartridge 5.

The developing roller 6 and the toner supply roller 8 are disposed parallel to each other and contact each other at predetermined pressure. The developing roller 6 and the toner supply roller 8 rotate in the same direction as shown by arrows in FIG. 2. The developing blade 7 and the developing roller 6 are disposed parallel to each other so that a bent portion of the developing blade 7 contacts the surface of the developing roller 6 at a predetermined pressure.

As shown in FIG. 1, the transfer rollers 12 are disposed so as to face the photosensitive bodies 1 of the four developing units 23K, 23Y, 23M and 23C. Each of the transfer rollers 12 is configured to have an electrically conductive rubber or the like. The transfer rollers 12 are urged against the transfer belt 11 that electrostatically absorbs and feeds the recording sheet 13 (FIG. 2). The transfer rollers 12 are applied with electric potentials, so that electric potential differences are formed between the photosensitive bodies 1 and the corresponding transfer rollers 12. With the electric potential differences, the toner images are transferred from the photosensitive bodies 1 to the recording sheet 13 (FIG. 2).

A fixing unit 25 (FIG. 1) includes a heating roller 25*a* and a backup roller 25*b* that apply heat and pressure to the toner image 14 (FIG. 2) of respective colors having been transferred to recording sheet 13 by the developing units 23K, 23Y, 23M and 23C and the transfer rollers 12. With this, the toner image 14 is fixed to the recording sheet 13. Feeding roller pairs 18 and 19 are disposed on the downstream side of the fixing unit 25 along the sheet feeding path 15. The feeding roller pairs 18 and 19 eject the recording sheet 13 to a stacker 21 on the upper frame 26.

As shown in FIG. 2, the toner cartridge 5 includes a fresh toner storing portion 5*a* as a fresh developer storing container, and a waste toner storing portion 33 as a developer storing container (i.e., a developer storing portion). The fresh toner storing portion 5*a* stores the fresh toner 4. The waste toner storing portion 33 stores a waste toner 4' which has been collected by the toner collecting portion 111 and conveyed by a conveying mechanism (described later). A toner agitating member 39 is provided in the vicinity of the toner supply opening 34 in such a manner that both ends are rotatably supported by the toner cartridge 5. The fresh toner 4 in the fresh toner storing portion 5*a* is led to the toner supply opening 34 when the toner agitating member 39 is rotated by a not shown driving unit. The toner supply opening 34 is opened and closed by a shutter 40 rotatably provided in the fresh toner storing portion 5*a*.

As described later, the waste toner storing portion 33 has a collection opening 32 (i.e., a developer supply opening) formed on a side in the longitudinal direction of the waste toner storing portion 33 (i.e., the Y direction). The waste toner 4' is supplied into the waste toner storing container 33 via the collection opening 32, and is conveyed in a predetermined direction (the −Y direction) by a rotation member 31 rotatably provided in the waste toner storing portion 33 so as to extend in the longitudinal direction of the waste toner storing portion 33.

Figure 3:
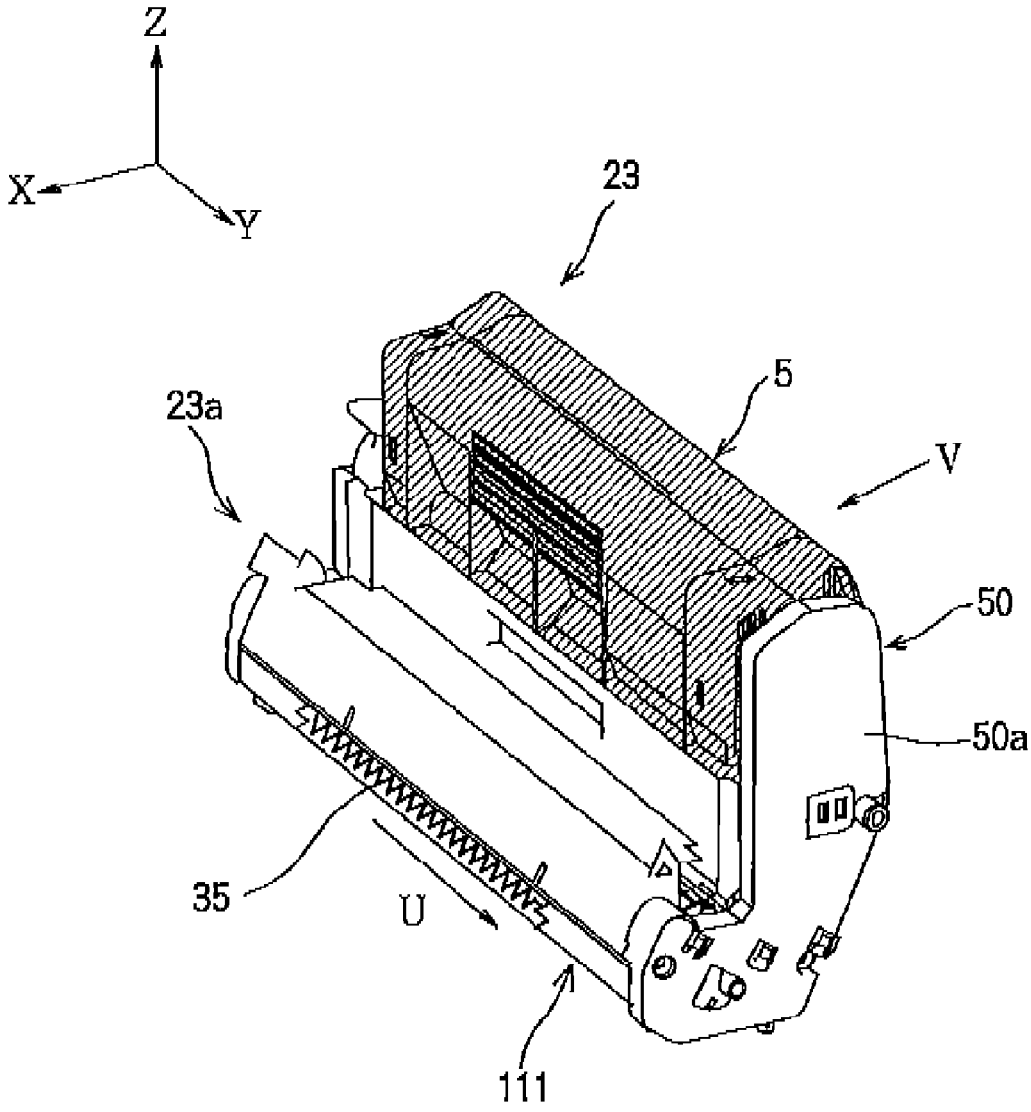
FIG. 3 is a partially cutaway perspective view of the developing unit for showing a waste toner conveying member provided therein.
Figure 4:
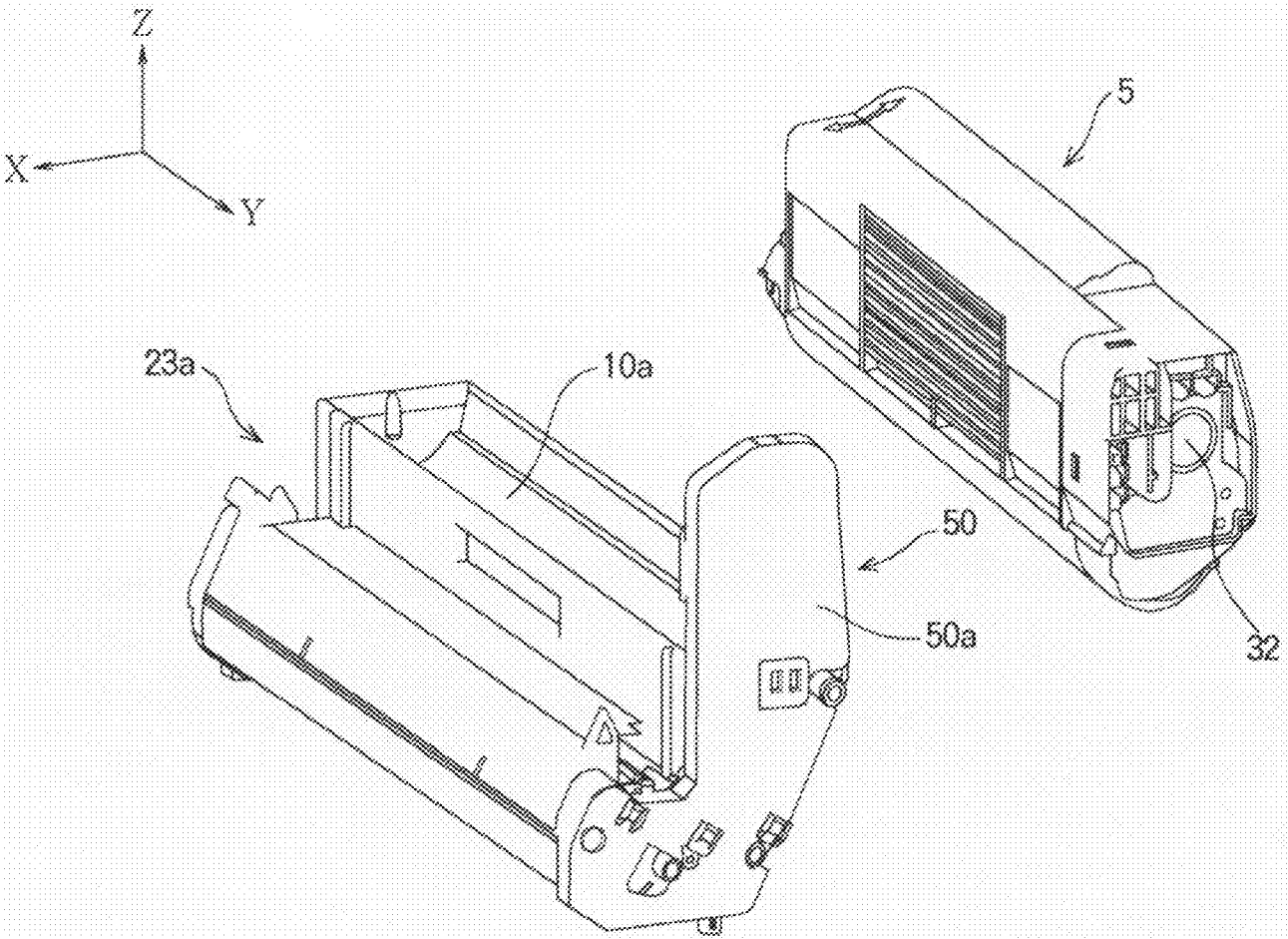
FIG. 4 is a perspective view separately showing the toner cartridge and a developing unit main body of the developing unit shown in FIG. 3.
Figure 5:
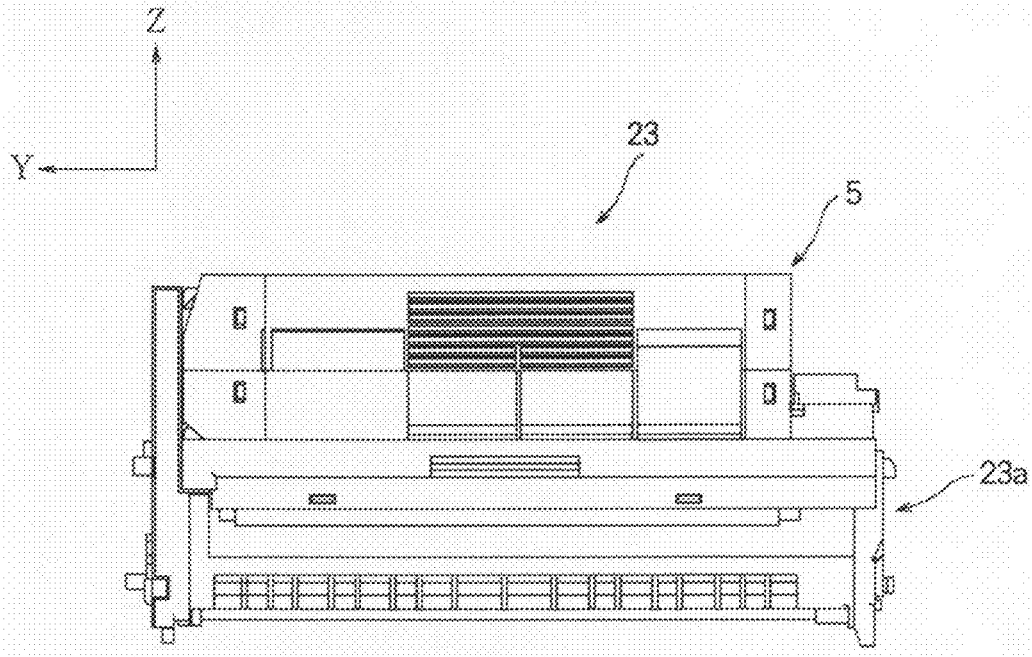
FIG. 5 is a rear view showing the developing unit of FIG. 3 as seen in the direction shown by an arrow V in FIG. 3.
Figure 6:
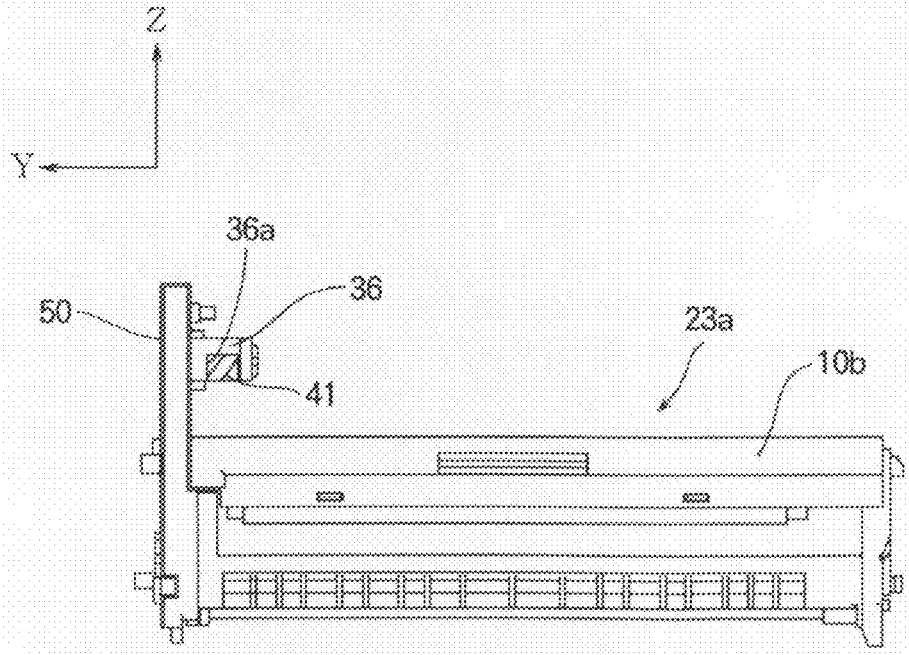
FIG. 6 is a rear view showing the developing unit main body of the developing unit of FIG. 3 as seen in the direction shown by the arrow V in FIG. 3.
Figure 7:
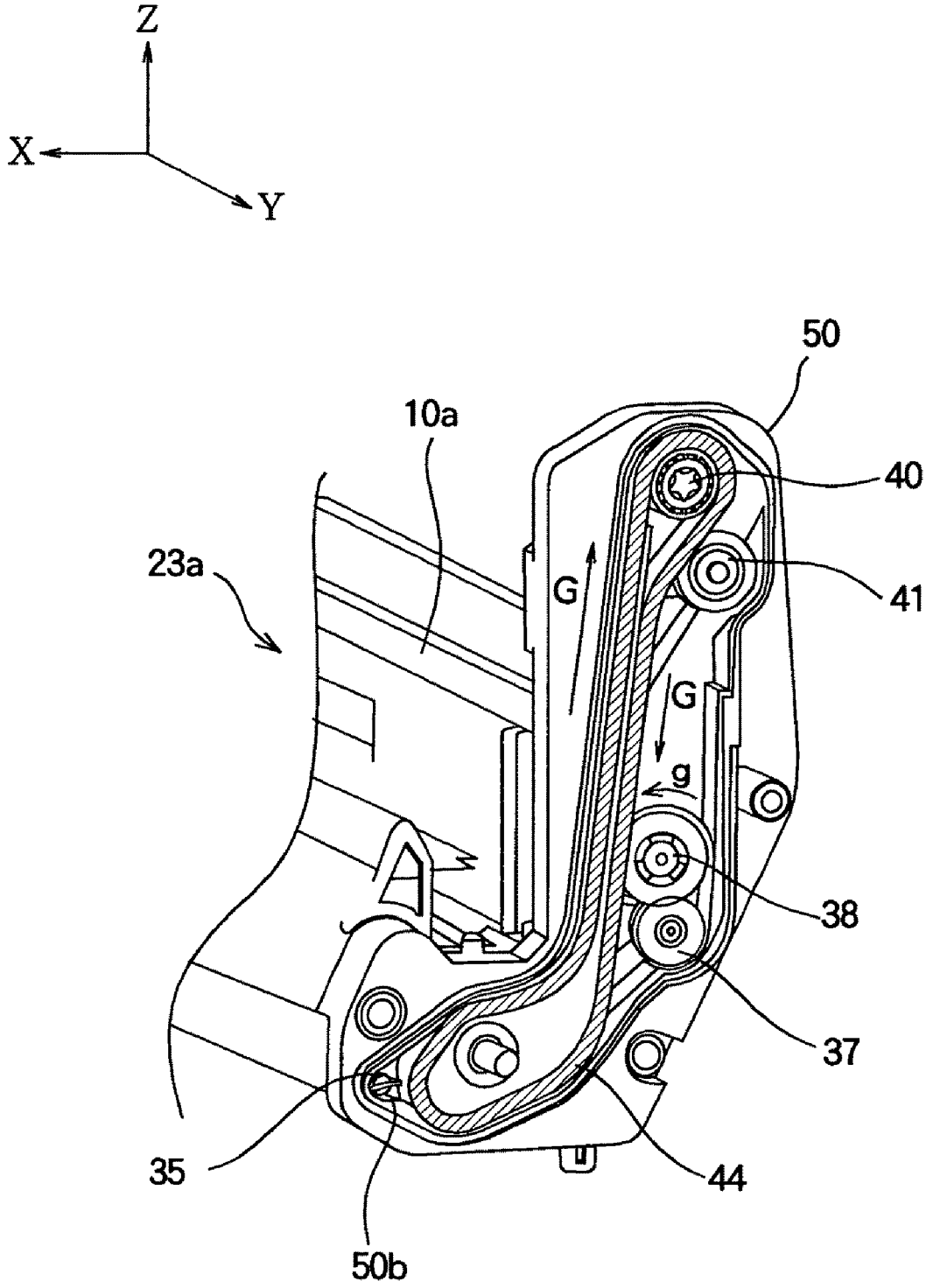
FIG. 7 is a perspective view showing a side frame of the developing unit main body in such a manner that a frame cover of the side frame is removed for showing a waste toner collection mechanism provided in the side frame.

FIG. 3 is a perspective view showing an outer shape of the developing unit 23. In FIG. 3, the developing unit 23 is partially cut away for showing the waste toner conveying member 35 provided in the developing unit 23. Further, in FIG. 3, the toner cartridge 5 is indicated by hatching. FIG. 4 is a perspective view showing the developing unit 23 in a state where the toner cartridge 5 is separated from the developer unit main body 23*a*. FIG. 5 is a rear view of the developing unit 23 as seen in a direction shown by an arrow V in FIG. 3. FIG. 6 is a rear view of the developing unit main body 23*a* as seen in a direction shown by the arrow V in FIG. 3. FIG. 7 is a perspective view showing a side frame 50 of the developing unit main body 23*a* with a frame cover 50*a* (FIG. 4) being removed for showing the waste toner collection mechanism provided in the side frame 50.

As shown in FIG. 7, the side frame 50 has an opening 50*b* leading to an interior of the waste toner collecting portion 111 (FIG. 3). The conveying member 35 conveys the waste toner from the waste toner collecting portion 111 into the side frame 50 via the opening 50*b*. A collection belt 44 in the form of a caterpillar belt is provided in the side frame 50. The collection belt 44 is moved by an action gear 38 so as to convey the waste toner from a lower position proximal and below the opening 50*b* to an upper position proximal and above an ejection spiral 41. The action gear 38 is driven by a driving gear 37 to rotate in the direction shown by an arrow g, and moves the collection belt 44 in the direction shown by an arrow G. A pulley 40 is provided on a position proximal and above the ejection spiral 41. The pulley 40 guides the collection belt 44 so as not to apply a sliding load to the collection belt 44.

As shown in FIG. 6, the ejection spiral 41 extends into a cylindrically-shaped toner ejecting portion 36 (i.e., a developer ejecting portion) provided on the side frame 50. The toner ejecting portion 36 is disposed on the mounting side (i.e., a right side in FIG. 6) of the side frame 50 to which the toner cartridge 5 is mounted. The toner ejecting portion 36 has a toner ejection opening 36*a* on a lower side thereof facing the ejection spiral 41 inserted into the toner ejecting portion 36. In a state where the toner cartridge 5 is mounted to the developing unit main body 23*a*, the toner ejecting portion 36 is inserted into the collection opening 32 (FIG. 4) formed on the toner cartridge 5, and is housed in the waste toner storing portion 33.

With reference to FIGS. 2 through 7, a process for storing the waste toner 4' (scraped off from the surface of the photosensitive body 1 by the cleaning blade 9 shown in FIG. 2) in the waste toner storing portion 33 of the toner cartridge 5 will be described.

As described above, the residual toner remaining on the surface of the photosensitive body 1 (FIG. 2) after the transferring of the toner image to the recording sheet 13 is removed by the cleaning blade 9, and falls in the waste toner collecting portion 111 as the waste toner 4'. The waste toner 4' having fallen in the waste toner collecting portion 111 is conveyed by the waste toner conveying member 35 (disposed in the waste toner collecting portion 111) in the direction shown by an arrow U in FIG. 3, i.e., in the direction toward the end of the waste toner collecting portion 111 on which the side frame 50 is provided. Further, the waste toner is conveyed from the waste toner collecting portion 111 into the side frame 50 via the opening 50*b* shown in FIG. 7. In the side frame 50, the waste toner 4' is conveyed upward by the collection belt 44 extending upward from the position proximal and below the opening 50*b*. The waste toner 4' conveyed upward by the collection belt 44 falls onto the ejection spiral 41 from above.

The ejection spiral 41 is disposed, for example, in contact with the collection belt 44. The ejection spiral 41 receives a rotational force from the collection belt 44, and rotates so as to convey the waste toner 4' (having fallen on the ejection spiral 41 from above) into the toner ejecting portion 36 (FIG. 6). Further, the ejection spiral 41 ejects the waste toner 4' via the toner ejection opening 36*a*, so that the waste toner 4' is supplied into the waste toner storing portion 33 of the toner cartridge 5.

Figure 8:
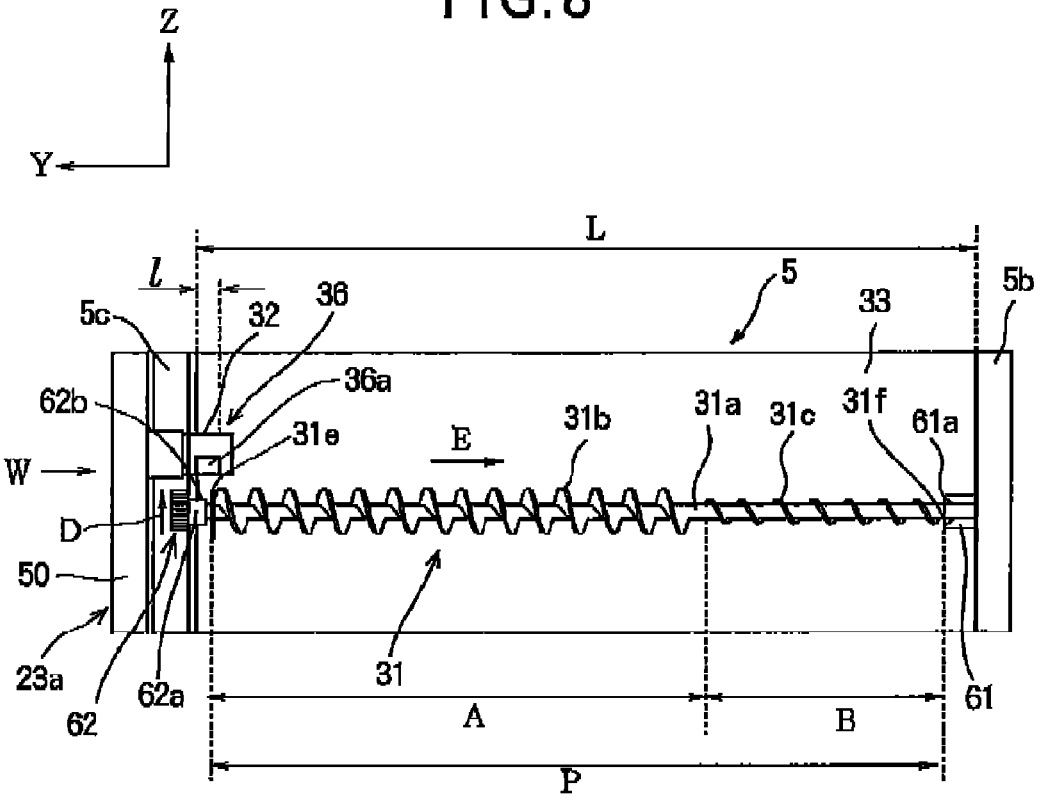
FIG. 8 is a schematic view showing an internal structure of the waste toner storing portion of the toner cartridge mounted to the developing unit main body according to Embodiment 1 of the present invention.

FIG. 8 is a schematic view showing the waste toner storing portion 33 of the toner cartridge 5 mounted to the developing unit main body 23*a*.

As shown in FIG. 2, the waste toner storing portion 33 and the fresh toner storing portion 5*a* are formed back-to-back. Further, as shown in FIG. 8, the waste toner storing portion 33 has an internal space extending in the longitudinal direction of the toner cartridge 5. The waste toner storing portion 33 has a side portion 5*c* and an opposite side portion 5*b* disposed on both ends in the longitudinal direction of the waste toner storing portion 33. The above described collection opening 32 is formed on the side portion 5*c*. The toner ejecting portion 36 protrudes into the waste toner storing portion 33 via the collection opening 32 formed on the end portion 5*c* of the toner cartridge 5, and the waste toner 4' falls into the waste toner storing portion 33 via the toner ejection opening 36*a*. Hereinafter, the side portion 5*c* of the toner cartridge 5 on which the toner ejecting portion 36 is provided is referred to as a "first" side portion 5*c* (i.e., a first end portion), and the opposite side portion 5*b* of the toner cartridge 5 is referred to as a "second" side portion 5*b* (i.e., a second end portion).

The rotation member 31 is provided below the toner ejection opening 36*a* and extends from the first side portion 5*c* toward the second side portion 5*b* of the toner cartridge 5. The rotation member 31 includes a shaft 31*a* having two regions in the longitudinal direction, i.e., a region A closer to the first side portion 5*c* and a region B closer to the second side portion 5*b*. The rotation member 31 further includes a first spiral blade 31*b* formed on the shaft 31*a* in the region A, and a second spiral blade 31*c* formed on the shaft 31*a* in the region B. An end of the shaft 31*a* (in the region A) is press-fitted into a rotation gear 62 provided with a bearing portion 62*a*. The bearing portion 62*a* is rotatably supported by the first side portion 5*c* of the toner cartridge 5. The other end of the shaft 31*a* (in the region B) engages a bearing portion 61 provided on the second side portion 5*b* of the toner cartridge 5, and is rotatably supported by the second side portion 5*b*.

In a state where the toner cartridge 5 is mounted to the developing unit main body 23*a*, the rotation gear 62 receives a rotational force in a predetermined direction (counterclockwise as seen in the direction shown by an arrow W) at a predetermined timing via, for example, a driving force transmitting portion (not shown) provided on the first side portion 5*c* of the toner cartridge 5. Therefore, the rotation member 31 rotates in the direction shown by an arrow D (FIG. 2), and the first spiral blade 31*b* and the second spiral blade 31*c* convey the waste toner 4' in the direction shown by an arrow E as described later.

The first spiral blade 31*b* and the second spiral blade 31*c* of the rotation member 31 are formed substantially throughout the whole length of the shaft 31*a* except the end portions held by the bearing portions 61 and 62*a*. A distance from an end portion 31*e* of the first spiral blade 31*b* to an end portion 62*b* of the bearing portion 62*a* and a distance from an end portion 31*f* of the second spiral blade 31*c* to an end portion 61*a* of the bearing portion 61 are close to each other, and each of the distances is set, for example, approximately in a range from 0 to 5 mm.

Figure 9:
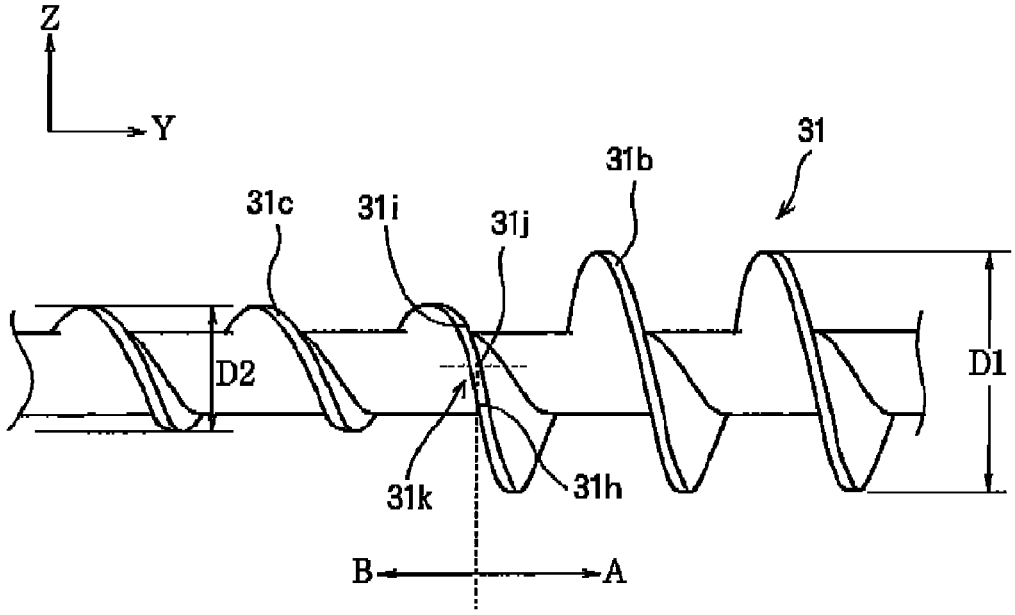
FIG. 9 is an enlarged view showing a part including a boundary between regions A and B of a rotation member of the toner cartridge of FIG. 8, as seen in the direction opposite to FIG. 8.

FIG. 9 is an enlarged partial view showing a part including a boundary between regions A and B, as seen in the direction opposite to FIG. 8.

As shown in FIG. 9, the first spiral blade 31*b* and the second spiral blade 31*c* are continuously formed. The second spiral blade 31*c* has an outer diameter D2 smaller than an outer diameter D1 of the first spiral blade 31*b*. Therefore, the rotation member 31 has a larger conveying power in the region A where the first spiral blade 31*b* is formed than in the region B where the second spiral blade 31*c* is formed.

The term "conveying power" is used to mean an amount of the waste toner conveyed by the rotation member 31 per unit time. The conveying power can also be referred to as a conveying capacity.

In this example, an end portion 31*h* of the first spiral blade 31*b* having a larger diameter and an end portion 31*i* of the second spiral blade 31*c* having a smaller diameter are smoothly connected via an intermediate region 31*k* where outer diameter changes. The boundary between the regions A and B is defined at a thicknesswise center position of an intermediate part 31*j* in the intermediate region 31*k*.

Although the first spiral blade 31*b* and the second spiral blade 31*c* are smoothly connected via the intermediate region 31*k* in this example, it is also possible that the end portion 31*h* of the first spiral blade 31*b* and the end portion 31*i* of the second spiral blade 31*c* are directly connected so as to form a step without the intermediate region 31*k*.

In this regard, the first spiral blade 31*b* and the second spiral blade 31*c* only need to be substantially connected to each other. Therefore, a gap (i.e., a region where no spiral blade is formed) of 10 mm or less can be provided between the regions A and B.

Next, a toner conveying operation by the rotation member 31 will be described. In this regard, the rotation member 31 is configured so that the ratio of the length of the region A to the length of the region B is approximately 2:1. The toner cartridge 5 having the rotation member 31 is mounted to the developing unit main body 23*a*, and the waste toner 4' falls into the waste toner storing portion 33 from the toner ejection opening 36*a*. The rotation member 31 is driven by the above described driving force transmitting portion (not shown) to rotate in the direction shown by the arrow D.

Figure 10:
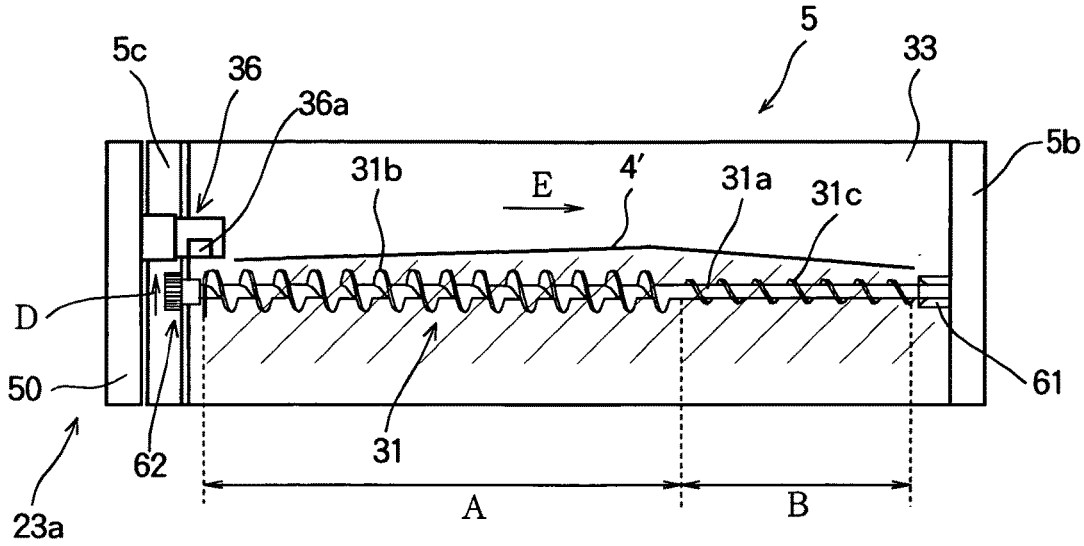
FIG. 10 is a schematic view for illustrating a toner conveying operation by the rotation member according to Embodiment 1 of the present invention.

As shown in FIG. 10, when the rotation member 31 rotates in the direction shown by the arrow D, the first spiral blade 31*b* and the second spiral blade 31*c* convey the waste toner 4' in the vicinity of the rotation member 31 in the direction shown by the arrow E. The conveying power of the second spiral blade 31*c* (having the smaller diameter) in the region B is smaller than the conveying power of the first spiral blade 31*b* (having the larger diameter) in the region A. Therefore, it becomes possible to convey the waste toner 4' in the waste toner storing portion 33 without excessively pushing the waste toner 4' toward the second side portion 5*b*.

Figure 11:
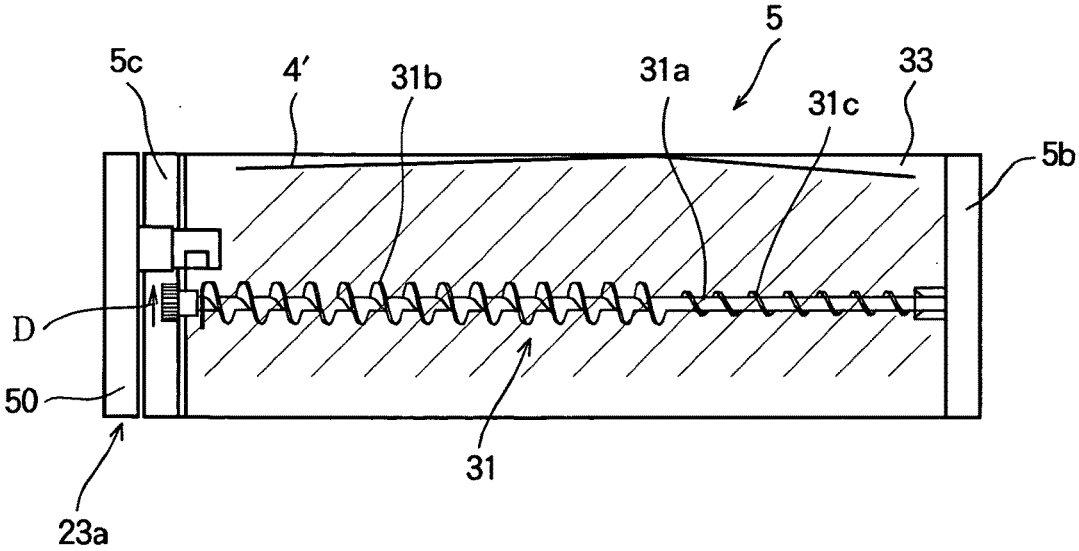
FIG. 11 is a schematic view for illustrating the toner conveying operation by the rotation member according to Embodiment 1 of the present invention.

FIG. 11 shows a state where a large amount of the waste toner 4' is supplied into the waste toner storing portion 33. In this state, the waste toner 4' is accumulated upward above the rotation member 31 while the waste toner 4' is conveyed by the rotation member 31 in the direction shown by the arrow E. Therefore, the waste toner 4' can be efficiently and evenly stored in the waste toner storing portion 33.

Figure 12:
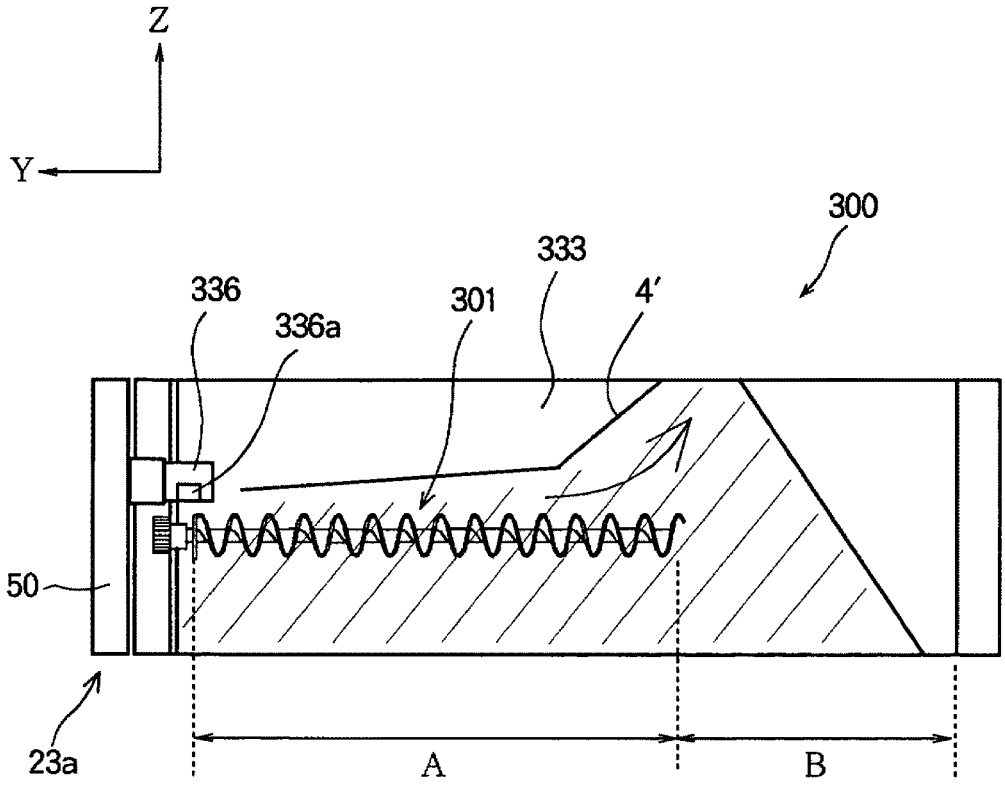
FIG. 12 shows a toner conveying operation according to comparative example.

FIG. 12 shows a toner cartridge 300 according to comparative example with respect to this embodiment. In the toner cartridge 300 of the comparative example shown in FIG. 12, a rotation member 301 extends partway in a waste toner storing portion 333. In other words, the rotation member 301 has a shaft and a spiral blade extending in a region A, but has no shaft or spiral blade in a region B. The waste toner 4' is supplied into the waste toner storing portion 333 by a toner ejecting portion 336 via a toner ejection opening 336*a*. In this case, the conveying power becomes zero at the end of the rotation member 301. Therefore, after the waste toner 4' in the waste toner storing portion 333 reaches the height of the rotation member 301, the waste toner 4' is thereafter accumulated in a concentrated manner above the end of the rotation member 301 as shown by an arrow in FIG. 12. Therefore, it is difficult to efficiently store the waste toner 4' in the waste toner storing portion 333. Further, if a large amount of the waste toner 4' is stored in the waste toner storing portion 333, a load acting on the rotation member 301 (particularly, a part where the waste toner 4' is most concentrated) increases. Therefore, an excessive load may act on the rotation member 301.

Next, a waste toner conveying test and an evaluation result thereof will be described. The test is performed while varying the ratio of the length of the region A (where the first spiral blade 31*b* is formed) to the length of the region B (where the second spiral blade 31*c* is formed) of the rotation member 31.

In the waste toner conveying test, the toner cartridge 5 (including the waste toner storing portion 33, the rotation member 31 or the like) is mounted to the developing unit main body 23*a*. The respective dimensions (see FIG. 8) of the toner cartridge 5 are as follows:

A length L of the waste toner storing portion 33 in the longitudinal direction thereof is 227 mm (i.e., L=227 mm).

A length l from the first side portion 5*c* of the waste toner storing portion 33 to the end of the toner ejection opening 36*a* is 7 mm (i.e., l=7 mm).

An entire length P of the first spiral blade 31*b* and the second spiral blade 31*c* is 223 mm (i.e., P=223 mm).

TABLE 1 shows the result of the waste toner conveying test. Second and third columns (the region A and the region B) of TABLE 1 indicate the ratio of the length of the region A to the length of the region B. For example, in Test 1, the ratio of the length of the region A to the length of the region B is 1:1. In other words, the length of the region A is the same as the length of the region B.

A fourth column of Table 1 indicates the ratio of the length of the region B to the entire length P of the regions A and B. For example, in Test 1, the ratio of the length of the region B to the entire length P of the regions A and B is 0.5 (=½).

A fifth column of TABLE 1 indicates an evaluation result of a performance in collecting the waste toner using marks O, Δ and X. These marks O, Δ and X respectively indicate as follows:

The mark "O" indicates that a sufficient amount of the waste toner 4' is conveyed to the second side portion 5*b* (FIG. 8) of the waste toner storing portion 33, and that no vacant space is left in the waste toner storing portion 33 when the waste toner storing portion 33 becomes unable to store more waste toner 4'.

The mark "Δ" indicates that a vacant space occupies less than 10% of the whole volume of the waste toner storing portion 33 when the waste toner storing portion 33 becomes unable to store more waste toner 4'.

The mark "X" indicates that a vacant space occupies 10% or more of the whole volume of the waste toner storing portion 33 when the waste toner storing portion 33 becomes unable to store more waste toner 4'.

As shown in TABLE 1, when the ratio of the length of the region A to the length of the region B is 1:1 (Test 1), the evaluation result of the performance in collecting the waste toner is "X". In this case, the waste toner 4' is not sufficiently conveyed to the second side portion 5*b* of the waste toner storing portion 33. Therefore, the vacant space of 10% or more (approximately 13%) of the whole volume of the waste toner storing portion 33 exists in an upper right part of the waste toner storing portion 33 in FIG. 8 when a left part in the waste toner storing portion 33 is filled with the waste toner 4' (i.e., when the waste toner storing portion 33 becomes unable to store more waste toner 4').

When the ratio of the length of the region A to the length of the region B is 9:8 (Test 2), the evaluation result is "Δ". In this case, the waste toner 4' is conveyed to the second side portion 5*b* of the waste toner storing portion 33. However, the vacant space of less than 10% (approximately 9%) of the whole volume of the waste toner storing portion 33 exists in the upper right part of the waste toner storing portion 33 in FIG. 8 when the left part in the waste toner storing portion 33 is filled with the waste toner 4' (i.e., when the waste toner storing portion 33 becomes unable to store more waste toner 4').

When the ratio of the length of the region A to the length of the region B is from 7:5 to 7:2 (Tests 3-7), the evaluation result is "O". In these cases, no vacant space exists in the waste toner storing portion 33 when the waste toner storing portion 33 becomes unable to store more waste toner 4'.

When the ratio of the length of the region A to the length of the region B is from 7:1 to 9:1 (Tests 8-10), the evaluation result is "Δ". In these cases, the waste toner 4' is sufficiently conveyed to the second side portion 5*b* of the waste toner storing portion 33. However, the waste toner 4' is excessively conveyed to the right part in the waste toner storing portion 33 in FIG. 8. Therefore, a load acting on the rotation member 31 excessively increases so that the waste toner storing portion 33 becomes unable to store more waste toner 4'. The vacant space of less than 10% of the whole volume of the waste toner storing portion 33 exists on an upper left part (i.e., above the toner ejection portion 36) of the waste toner storing portion 33. The volume of the vacant space is approximately 4%, 6% and 8% respectively when the ratio of the length of the region A to the length of the region B is 7:1, 8:2 and 9:1.

When the ratio of the length of the region A to the length of the region B is 10:1 (Tests 11), the evaluation result is "X". In this case, the waste toner 4' is sufficiently conveyed to the second side portion 5*b* of the waste toner storing portion 33. However, the waste toner 4' is excessively conveyed to the right part in the waste toner storing portion 33 in FIG. 8. Therefore, a load acting on the rotation member 31 excessively increases so that the waste toner storing portion 33 becomes unable to store more waste toner 4'. The vacant space of 10% or more (approximately 13%) of the whole volume of the waste toner storing portion 33 exists on the upper left part (i.e., above the toner ejection portion 36) of the waste toner storing portion 33.

TABLE 1

| TEST NO. | RATIO OF LENGTH OF REGION A TO REGION B: REGION A | RATIO OF LENGTH OF REGION A TO REGION B: REGION B | RATIO OF LENGTH OF REGION B TO ENTIRE LENGTH | EVALUATION RESULT |
|---|---|---|---|---|
| 1 | 1 | 1 | 0.50 | X |
| 2 | 9 | 8 | 0.47 | Δ |
| 3 | 7 | 5 | 0.42 | ○ |
| 4 | 3 | 2 | 0.40 | ○ |
| 5 | 2 | 1 | 0.33 | ○ |
| 6 | 3 | 1 | 0.25 | ○ |

TABLE 1-continued

| TEST NO. | RATIO OF LENGTH OF REGION A TO REGION B: REGION A | RATIO OF LENGTH OF REGION A TO REGION B: REGION B | RATIO OF LENGTH OF REGION B TO ENTIRE LENGTH | EVALUATION RESULT |
|---|---|---|---|---|
| 7 | 7 | 2 | 0.22 | ○ |
| 8 | 7 | 1 | 0.13 | Δ |
| 9 | 8 | 1 | 0.11 | Δ |
| 10 | 9 | 1 | 0.10 | Δ |
| 11 | 10 | 1 | 0.09 | X |

As described above and as shown in FIG. 8, in the case where the rotation member 31 conveys the waste toner 4' in the regions A and B with a conveying power that varies in a stepwise fashion (i.e., the conveying power in the region A is greater than the conveying power in the region B), it becomes possible to effectively store the waste toner 4' in the waste toner storing portion 33 when the ratio of the length of the region A to the length of the region B is in a predetermined range (i.e., from 7:5 to 7:2).

In this embodiment, the conveying power in the region A is made larger than the conveying power in the region B by setting different outer diameters for the spiral blades 31*b* and 31*c* in the regions A and B. However, it is also possible to setting different pitches for the spiral blades 31*b* and 31*c* instead of the outer diameters.

Figure 13:
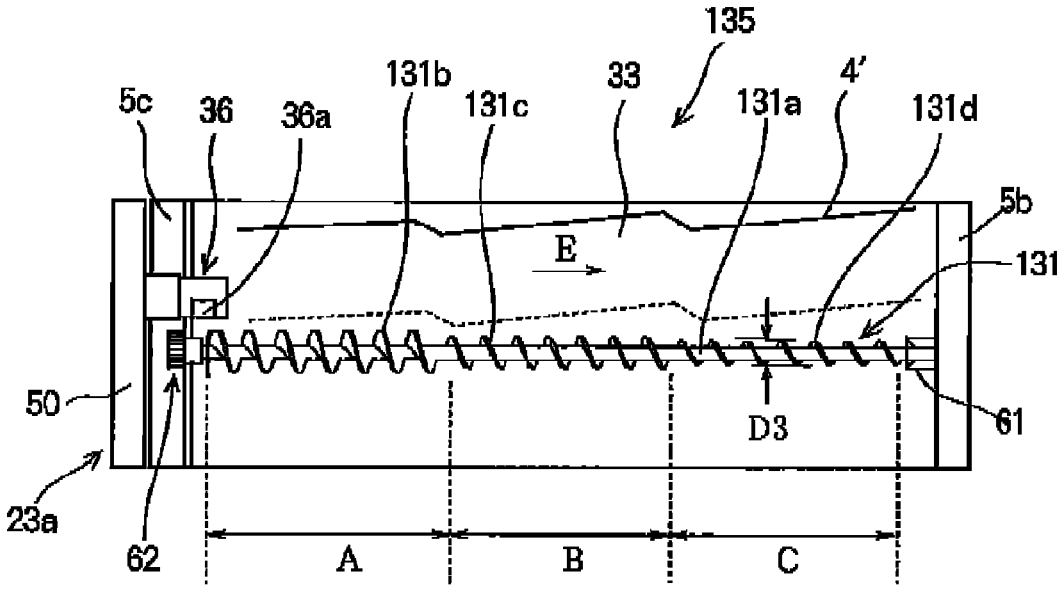
FIG. 13 is a schematic view showing a modification of the toner cartridge according to Embodiment 1 of the present invention.

FIG. 13 shows a modification of the toner cartridge of Embodiment 1. The toner cartridge 135 of this modification has a rotation member 131 including a shaft 131*a*, a first spiral blade 131*b*, a second spiral blade 131*c* and a third spiral blade 131*d*. The first spiral blade 131*b*, the second spiral blade 131*c* and the third spiral blade 131*d* are formed on the shaft 131*a* and have different outer diameters. The outer diameters D1, D2, D3 of the first, second and third spiral blades 131*b*, 131*c* and 131*d* satisfy:

$$D1>D2>D3.$$

With such a configuration, the rotation member 131 has regions A, B and C where the conveying power decreases in a stepwise fashion in the direction shown by an arrow E.

According to this modification, the conveying power of the rotation member 131 decreases in a stepwise fashion (in this example, in three steps) from the first side portion 5*c* toward the second side portion 5*b*, and therefore the waste toner 4' can be effectively stored in the waste toner storing portion 33 as is the case with the above described toner cartridge 5.

Figure 14:
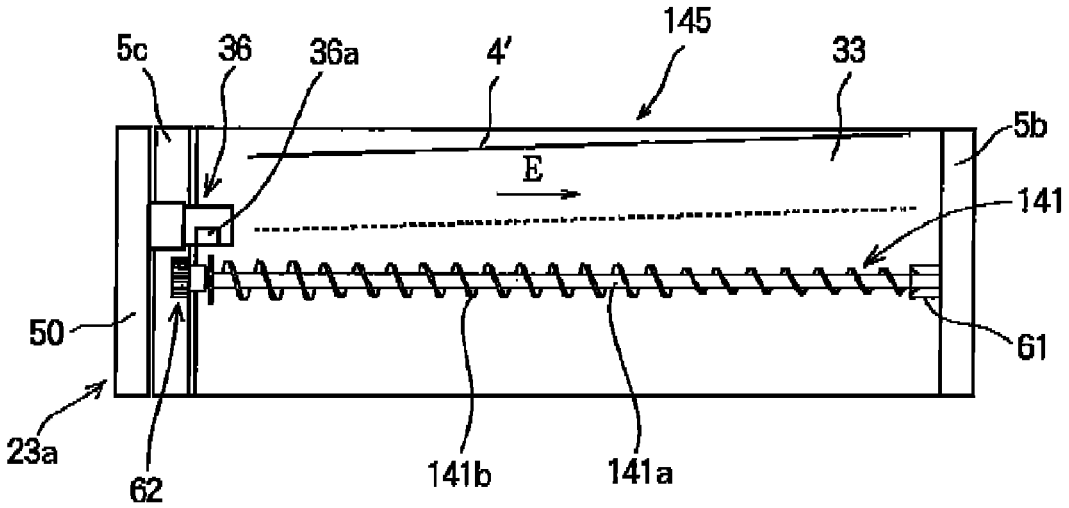
FIG. 14 is a schematic view showing another modification of the toner cartridge according to Embodiment 1 of the present invention.

FIG. 14 shows another modification of the toner cartridge of Embodiment 1. The toner cartridge 145 of this modification has a rotation member 141 including a shaft 141*a* and a spiral blade 141*b* formed on the shaft 141*a*. The outer diameter of the spiral blade 141*b* decreases in a stepless fashion (i.e., continuously) from the first side portion 5*c* toward the second side portion 5*b*. Therefore, in this modification, the conveying power of the rotation member 141 (in the direction shown by an arrow E) continuously decreases from the first side portion 5*c* (i.e., the toner ejection opening 36*a*) toward the second side portion 5*b*.

According to this modification, the conveying power of the rotation member 141 continuously decreases from the first side portion 5*c* toward the second side portion 5*b*, and therefore the waste toner 4' can be effectively stored in the waste toner storing portion 33 as is the case with the above described toner cartridge 5.

In the above described modification shown in FIG. 14, since the conveying power decreases in a stepless fashion in the direction shown by the arrow E, there is a possibility that the rotation member 141 may not sufficiently convey the waste toner 4' toward the second side portion 5*b* (to the right in FIG. 14) if a large amount of the waste toner 4' is supplied into the waste toner storing portion 143. In contrast, in Embodiment 1 in which the conveying power of the rotation member 31 decreases in two steps as shown in FIG. 9, the rotation member 31 can just sufficiently convey the waste toner 4' toward the second side portion 5*b* by setting the ratio of the length of the region A to the length of the region B to a suitable ratio.

Figure 15A:
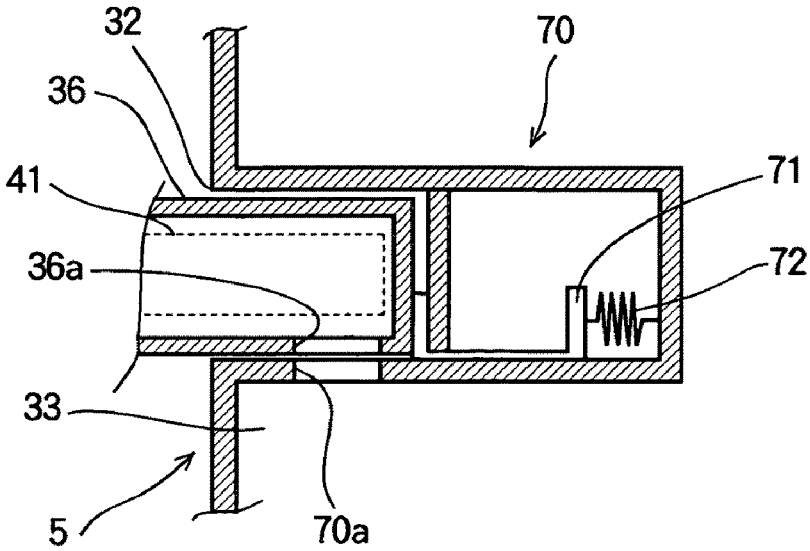
FIGS. 15A and 15B are sectional views for illustrating an operation in a case where the toner cartridge has a receiving cylinder extending inwardly with respect to a collection opening.

In the above description, the toner ejecting portion 36 of the developing unit main body 23*a* is inserted into the collection opening 32 formed on the waste toner storing portion 33 of the toner cartridge 5. In this regard, it is preferable that the toner cartridge 5 has a receiving cylinder 70 extending inward with respect to the collection opening 32 as shown in FIG. 15A. The receiving cylinder 70 has a function to close the collection opening 32 as necessary and a function to prevent the waste toner 4' from adhering to the toner ejecting portion 36 (such waste toner 4' may remain adhering to the toner ejecting portion 36 after the toner cartridge 5 is detached from the developing unit main body 23*a*).

As shown in FIG. 15A, in a state where the toner cartridge 5 is mounted to the developing unit main body 23*a*, the toner ejecting portion 36 is inserted into the receiving cylinder 70 via the collection opening 32. In this state, the toner ejection opening 36*a* of the toner ejecting portion 36 is aligned with a toner receiving hole 70*a* formed on the receiving cylinder 70, so that the waste toner 4' conveyed by the ejection spiral 41 falls into the waste toner storing portion 33 via the toner ejection opening 36*a* and the toner receiving hole 70*a*. Further, in this state, the toner ejecting portion 36 is covered with the receiving cylinder 70, and therefore the waste toner 4' in the waste toner storing portion 33 does not adhere to the toner ejecting portion 36.

Figure 15B:
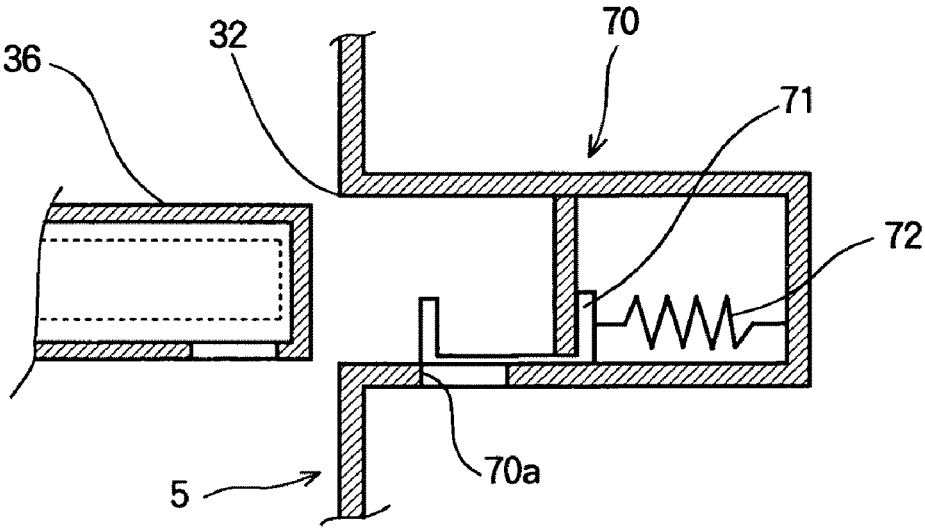

As shown in FIG. 15B, when the toner cartridge 5 is detached from the developing unit main body 23*a*, a lid 71 provided in the receiving cylinder 70 is moved by a compression spring 72 to a position where the lid 71 closes the toner receiving hole 70*a*. In this state, the waste toner storing portion 33 is shielded from outside, and therefore the waste toner 4' does not leak outside. Further, since the waste toner 4' (in the waste toner storing portion 33) does not adhere to the toner ejecting portion 36 being detached from the developer unit main body 23*a*, the waste toner 4' does not scatter into the surroundings of the developing unit 23.

As described above, according to the toner cartridge 5 of Embodiment 1, the rotation member 31 has the conveying power for conveying the waste toner 4' substantially throughout the entire region in the waste toner storing portion 33, and the conveying power is larger in the region A closer to the first side portion 5*c* (i.e., the toner ejecting portion 36*a*) than in the region B closer to the second side portion 5*b*. Therefore, the waste toner 47 can be conveyed efficiently throughout the entire region of the waste toner storing portion 33 without causing stagnation of the waste toner 4' and without generating excessive rotational load. Therefore, the waste toner can be effectively stored in the waste toner storing portion 33.

Embodiment 2

Figure 16:
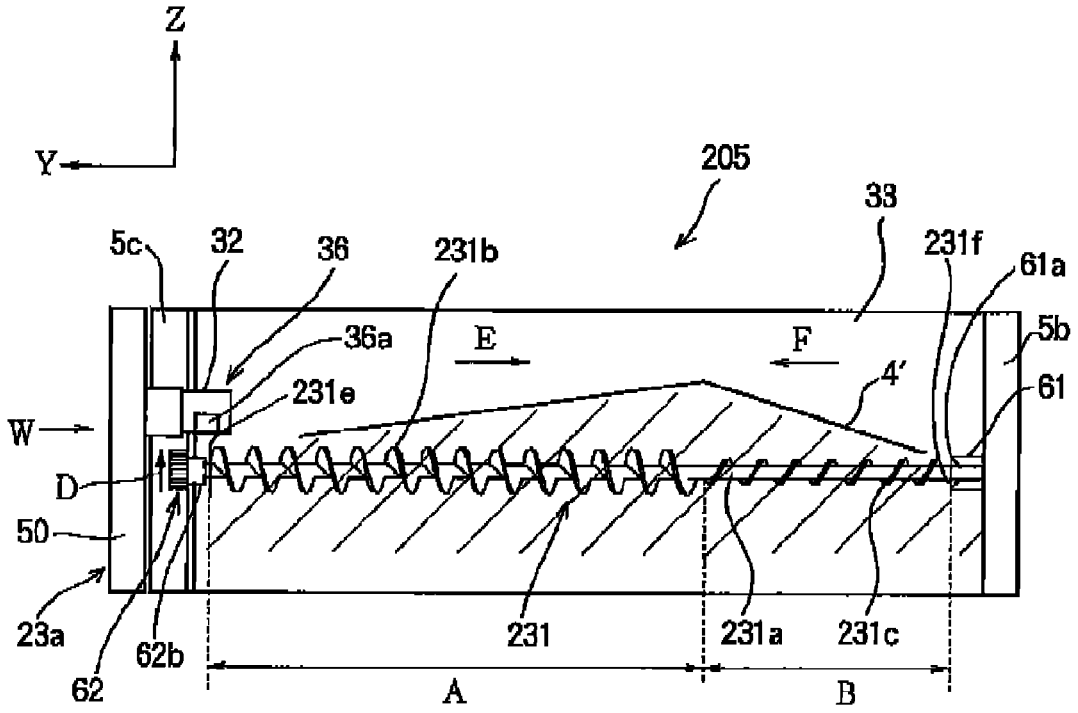
FIG. 16 shows an internal structure of a waste toner storing portion of the toner cartridge mounted to the developing unit main body according to Embodiment 2 of the present invention.

FIG. 16 is a schematic view showing a waste toner storing portion 33 of a toner cartridge 205 of an image forming apparatus according to Embodiment 2 of the present invention.

The toner cartridge 205 of Embodiment 2 is different from the toner cartridge 5 (FIG. 8) of Embodiment 1 in the structure of a rotation member 231. Components that are the same as those of the toner cartridge 5 of Embodiment 1 are assigned the same reference numerals or omitted in figures, and description thereof will be omitted. Further, the image forming apparatus and the developing unit of Embodiment 2 are the same as those of Embodiment 1 except the structure of the toner cartridge 205, and therefore FIGS. 1 and 2 will be referred as necessary. Furthermore, the outer shape of the toner cartridge 205 is the same as that of the toner cartridge 5 of Embodiment 1, and therefore FIGS. 3 through 7 will be referred as necessary.

In the toner cartridge 205, the rotation member 231 is disposed below the toner ejection opening 36*a*. The rotation member 231 extends from the first side portion 5*c* to the second side portion 5*b* of the toner cartridge 205. The rotation member 231 includes a shaft 231*a*, a first spiral blade 231*b* formed on the shaft 231*a* in the region A closer to the first side portion 5*c* (on which the toner collection opening 32 is formed) and a second spiral blade 231*c* formed on the shaft 231*a* in the region B closer to the second side portion 5*b*. An end of the shaft 231*a* (in the region A) is press-fitted into a rotation gear 62 provided with a bearing portion 62*a*. The bearing portion 62*a* is rotatably supported by the first side portion 5*c* of the toner cartridge 205. The other end of the shaft 31*a* (in the region B) engages a bearing portion 61 provided on the second side portion 5*b* of the toner cartridge 205, and is rotatably supported by the second side portion 5*b*.

In a state where the toner cartridge 205 is mounted to the developing unit main body 23*a*, the rotation gear 62 receives a rotational force in a predetermined direction (counterclockwise as seen in the direction shown by an arrow W) at a predetermined timing via, for example, a driving force transmitting portion (not shown) provided on the first side portion 5*c* of the toner cartridge 205. Therefore, the rotation member 31 rotates in the direction shown by the arrow D (see FIG. 2), and the first spiral blade 231*b* and the second spiral blade 231*c* convey the waste toner 4' in directions as shown by arrows E and F in FIG. 16. In this Embodiment, the first spiral blade 231*b* and the second spiral blade 231*c* are configured to convey the waste toner 4' in directions toward each other.

The first spiral blade 231*b* and the second spiral blade 231*c* of the rotation member 231 are formed substantially throughout the whole length of the shaft 231*a* except the ends supported by the bearing portions 61 and 62*a*. The distance from the end 231*e* of the first spiral blade 231*b* to the end 62*b* of the bearing portion 62*a*, and the distance from the end 231*f* of the second spiral blade 231*c* to the end 61*a* of the bearing portion 61 are close to each other, and each of the distances is set, for example, approximately in a range from 0 to 5 mm.

Figure 17:
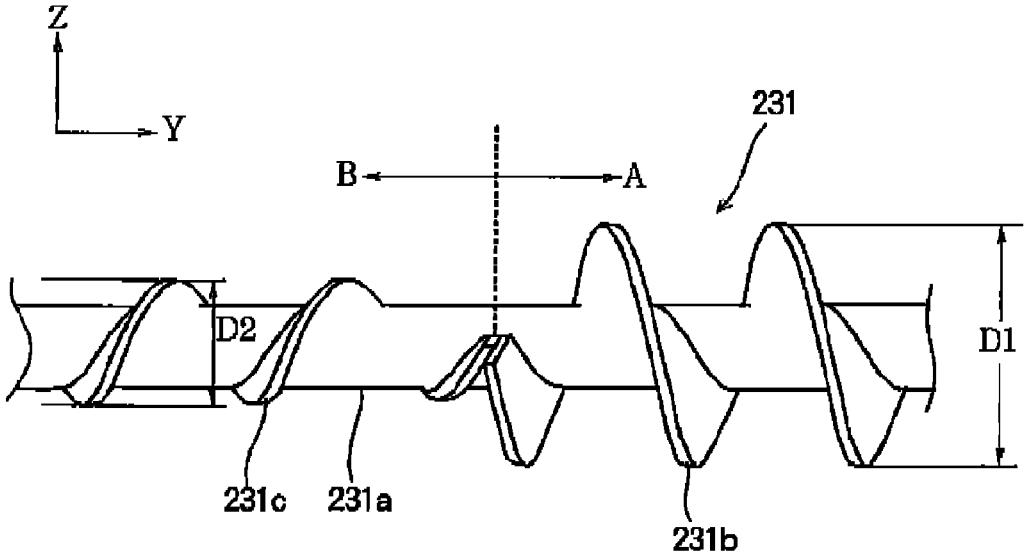
FIG. 17 is an enlarged view showing a part including a boundary between regions A and B of a rotation member according to Embodiment 2 of the present invention, as seen in the direction opposite to FIG. 16.

FIG. 17 is an enlarged partial view showing a part including a boundary between the region A and the region B of the rotation member 231, as seen in the direction opposite to FIG. 16.

As shown in FIG. 17, the first spiral blade 231*b* and the second spiral blade 231*c* are continuously formed, but gyrate in opposite directions. The second spiral blade 231*c* has an outer diameter D2 smaller than the outer diameter D1 of the first spiral blade 231*b*. Therefore, the conveying power of the first spiral blade 231*b* in the region A is larger than the conveying power of the second spiral blade 231*c* in the region B. In this regard, the boundary between the regions A and B is defined at a position where the first spiral blade 231*b* and the second spiral blade 231*c* intersect with each other as shown in FIG. 17.

In this regard, the first spiral blade 231*b* and the second spiral blade 231*c* only need to be substantially continuous with each other. Therefore, a gap (i.e., a region where no spiral blade is formed) of 10 mm or less can be provided between the regions A and B.

Next, a toner conveying operation by the rotation member 231 will be described. In this regard, the rotation member 231 is configured so that the ratio of the length of the region A to the length of the region B is approximately 2:1. The toner cartridge 205 having such rotation member 231 is mounted to the developing unit main body 23*a*, and the waste toner 4' falls into the waste toner storing portion 33 from the toner ejection opening 36*a*. The rotation member 31 is driven by the driving force transmitting portion (not shown) to rotate in the direction shown by the arrow D.

As shown in FIG. 16, when the rotation member 31 rotates in the direction shown by the arrow D (FIG. 2), the first spiral blade 231*b* (in the region A) conveys the waste toner 4' in the direction shown by the arrow E, and the second spiral blade 231*c* (in the region B) conveys the waste toner 4' in the direction shown by the arrow F. The conveying power of the second spiral blade 231*c* (having the smaller diameter) in the region B is smaller than the conveying power of the first spiral blade 231*b* (having the larger diameter) in the region A. Therefore, the waste toner 4' having fallen from the toner ejection opening 36*a* is conveyed in the direction shown by the arrow E with a relatively larger power in the region A, and is pushed back with a relatively small power in the region B. Accordingly, the waste toner 4' is not excessively pushed toward the second side portion 6*b* of the waste toner storing portion 33.

Figure 18:
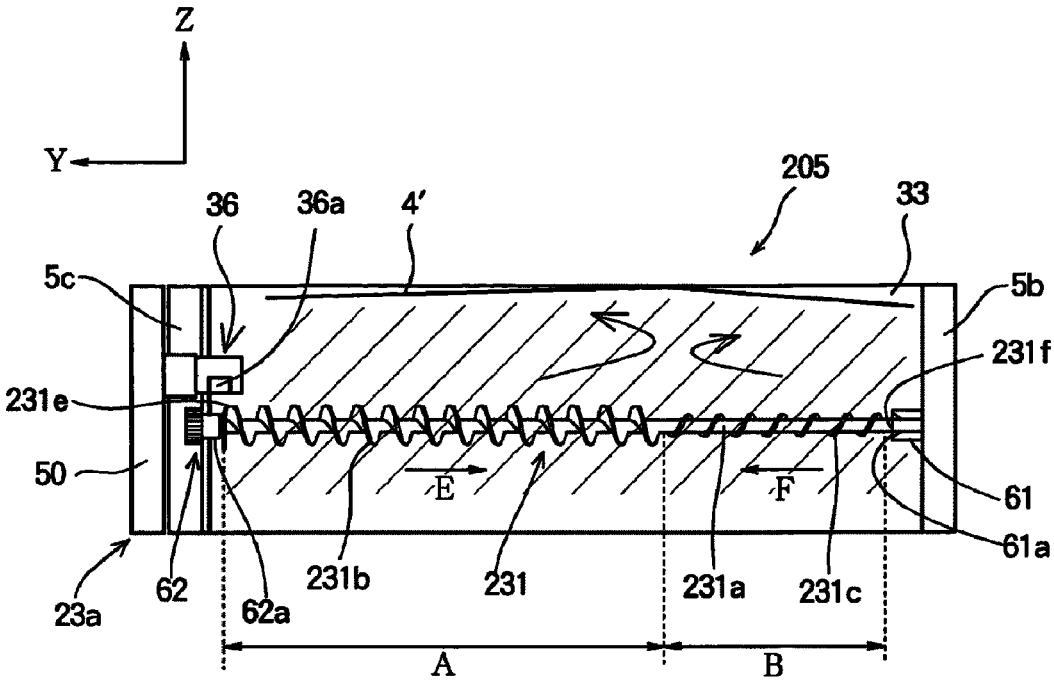
FIG. 18 shows a toner conveying operation by the rotation member according to Embodiment 2 of the present invention.

FIG. 18 shows a state where a large amount of the waste toner 4' is supplied into the waste toner storing portion 33. In this state, the waste toner 4' conveyed by the rotation member 231 is accumulated upward above the boundary between the regions A and B (in which the spiral blades 231*b* and 231*c* gyrate in opposite directions) as shown by arrows in FIG. 18, and therefore the waste toner 4' is disentangled. Thus, the waste toner 4' can be accumulated in the waste toner storing portion 33 in such a manner that the waste toner 4' is leveled evenly, and efficiently stored in the waste toner storing portion 33.

Figure 19:
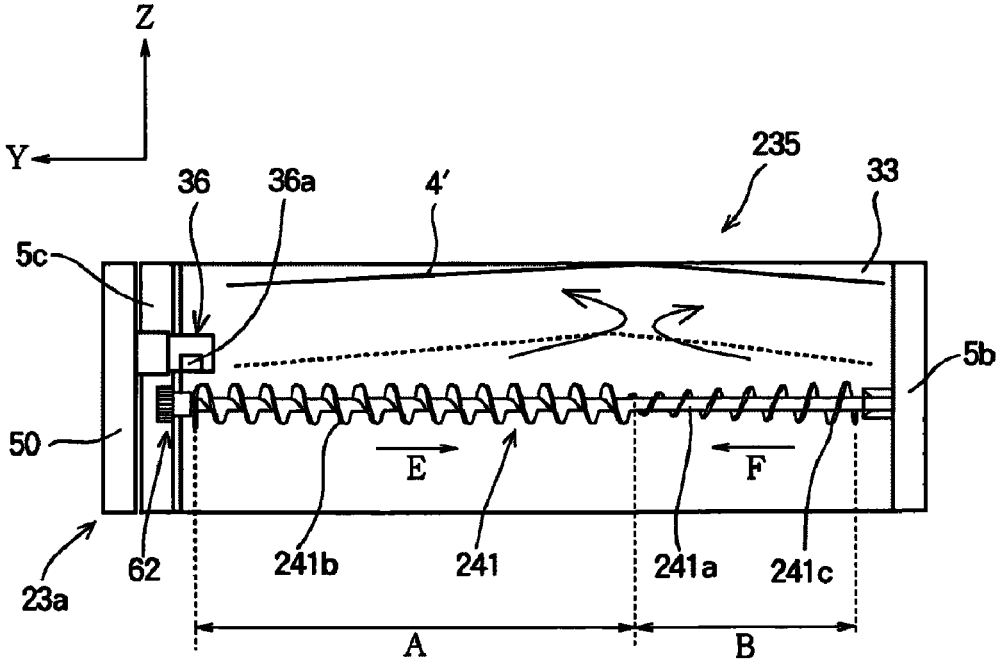
FIG. 19 shows the toner conveying operation by the rotation member according to Embodiment 2 of the present invention.

FIG. 19 shows a modification of the toner cartridge according to Embodiment 2. The toner cartridge 235 of this modification includes a rotation member 241. The rotation member 241 includes a shaft 241*a*, a first spiral blade 241*b* formed on the shaft 241*a* in the region A and a second spiral blade 241*c* formed on the shaft 241*a* in the region B. The outer diameter of the first spiral blade 241*b* is constant, and is larger than the outer diameter of the second spiral blade 241*c*. In contrast, the outer diameter of the second spiral blade 241*c* continuously increases from the boundary between the regions A and B toward the second side portion 5*b*. With such a configuration, in the region B, the conveying power decreases from the second side portion 5*b* toward the boundary between the regions A and B. Therefore, a load applied to the rotation member 241 by the waste toner 4' accumulated above the boundary between the regions A and B is reduced, and the efficiency in collecting the waste toner 4' can be enhanced.

As described above, according to the toner cartridge of Embodiment 2, the conveying direction of the waste toner 4' in the region B closer to the second side portion 5*b* is opposite to the conveying direction of the waste toner 4' in the region A closer to the first side portion 5*c* (i.e., the toner ejection opening 36*a*). Therefore, the waste toner 4' is not excessively pushed toward the second side portion 5*b*, and the rotational load is reduced. Further, since the waste toner 4' is accumulated upward above the boundary between the regions A and B (where the conveying directions are opposite to each other), the waste toner is disentangled. Therefore, the waste toner can be efficiently conveyed throughout the entire region in the waste toner storing portion 33, and can be effectively stored in the waste toner storing portion 33.

While the preferred embodiments of the present invention have been illustrated in detail, it should be apparent that modifications and improvements may be made to the invention without departing from the spirit and scope of the invention as described in the following claims.

What is claimed is:

1. A developer collection container comprising:

a developer storing portion for storing a developer, said developer storing portion having an elongated shape and having first and second end portions in a longitudinal direction thereof;

a developer supply opening provided on said first end portion of said developer storing portion through which the developer is supplied into said developer storing portion, and a rotation member rotatably provided in said developer storing portion so as to extend substantially from said first end portion to said second end portion in said longitudinal direction of said developer storing portion, said rotation member rotating in a predetermined direction so as to convey the developer in a direction from said first end portion to said second end portion along said longitudinal direction, and a conveying power with which said rotation member conveys the developer in a first region closer to said first end portion being larger than a conveying power with which said rotation member conveys the developer in a second region closer to said second end portion, a ratio of said first region to said second region being in a range from 7:5 to 7:2.

2. The developer collection container according to claim 1, wherein said rotation member includes a spiral blade with which said rotation member conveys the developer.

3. The developer collection container according to claim 2, wherein a ratio of said first region to said second region is substantially 2:1.

4. The developer collection container according to claim 1, wherein said rotation member includes a continuously formed spiral blade.

5. The developer collection container according to claim 1, wherein said rotation member includes spiral blades having different diameters that provide different conveying powers.

6. The developer collection container according to claim 1, wherein said rotation member includes spiral blades formed at different pitches that provide different conveying powers.

7. A developer cartridge comprising:

said developer collection container according to claim 1, and a fresh developer collection container for storing a fresh developer.

8. A developing unit comprising:

said developer cartridge according to claim 7, and a developing unit main body to which said developer cartridge is detachably mounted, wherein said developer unit main body includes a developer ejecting portion that engages said developer supply opening of said developer cartridge so as to supply the developer into said developer storing portion.

9. An image forming apparatus comprising:

said developing unit according to claim 8.

10. The developer collection container according to claim 1, wherein said rotation member includes a first rotating portion located in said first region and a second rotating portion located in said second region, wherein said first rotation portion has a first diameter, and said second rotating portion has a second diameter smaller than said first diameter, and wherein said first rotating portion and said second rotating portion are continuously formed with each other via an intermediate portion having an outer diameter that changes from said first diameter to said second diameter.

11. A developer collection container comprising:

a developer storing portion for storing a developer, said developer storing portion having an elongated shape and having first and second end portions in a longitudinal direction thereof;

a developer supply opening provided on said first end portion of said developer storing portion through which the developer is supplied into said developer storing portion, and a rotation member rotatably provided in said developer storing portion so as to extend substantially from said first end portion to said second end portion in said longitudinal direction of said developer storing portion, said rotation member rotating in a predetermined direction so as to convey the developer in said longitudinal direction of said developer storing portion, wherein, in a first region closer to said first end portion, said rotation member conveys the developer in a direction from said first end portion toward said second end portion with a conveying power which is larger than a conveying power with which said rotation member conveys the developer in a second region closer to said second end portion, wherein said rotation member conveys the developer in said second region in a direction opposite to a direction in which said rotation member conveys the developer in said first region.

12. The developer collection container according to claim 11, wherein said rotation member includes a spiral blade with which said rotation member conveys the developer in said first and second regions in opposite directions with two different conveying powers.

13. The developer collection container according to claim 11, wherein said rotation member includes a first rotating portion located in said first region and a second rotating portion located in said second region, and said second rotating portion conveys the developer in a direction opposite to a direction in which said first rotating portion conveys the developer, and wherein outer circumferences of said first rotating portion and said second rotating portion are continuously connected to each other.

14. A developer collection container comprising:

a developer storing portion for storing a developer, said developer storing portion having an elongated shape and having first and second end portions in a longitudinal direction thereof;

a developer supply opening provided on said first end portion of said developer storing portion through which said developer is supplied into said developer storing portion, and a rotation member rotatably provided in said developer storing portion so as to extend substantially from said first end portion to said second end portion in said longitudinal direction of said developer storing portion, said rotation member rotating in a predetermined direction so as to convey said developer in said longitudinal direction developer storing portion, wherein, in a first region closer to said first end portion, said rotation member conveys said developer in a direction from said first end portion toward said second end portion with a conveying power which is larger than a conveying power with which said rotation member conveys said developer in a second region closer to said second end portion, wherein said rotation member conveys said developer in said second region in a direction opposite to a direction in which said rotation member conveys said developer in said first region, and wherein said rotation member conveys said developer in said first region with a constant conveying power, and conveys said developer in said second region with a conveying power that decreases in a direction from said second end portion toward said first end portion of said developer storing portion.

* * * * *